US011759939B2

(12) United States Patent
Johansson et al.

(10) Patent No.: US 11,759,939 B2
(45) Date of Patent: Sep. 19, 2023

(54) HANDHELD ELECTRIC POWER TOOL

(71) Applicant: ATLAS COPCO INDUSTRIAL TECHNIQUE AB, Stockholm (SE)

(72) Inventors: Karl Göran Johansson, Saltsjö-Boo (SE); Hans Johan Alfred Zander, Värmdö (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 301 days.

(21) Appl. No.: 17/254,413

(22) PCT Filed: Jun. 25, 2019

(86) PCT No.: PCT/EP2019/066732

§ 371 (c)(1),
(2) Date: Dec. 21, 2020

(87) PCT Pub. No.: WO2020/002269

PCT Pub. Date: Jan. 2, 2020

(65) Prior Publication Data

US 2021/0170566 A1 Jun. 10, 2021

(30) Foreign Application Priority Data

Jun. 29, 2018 (SE) ..... 1830206-7

(51) Int. Cl.
*B25F 5/02* (2006.01)

(52) U.S. Cl.
CPC ..... *B25F 5/02* (2013.01)

(58) Field of Classification Search
CPC ..... B25F 5/02
See application file for complete search history.

(56) References Cited

U.S. PATENT DOCUMENTS 4,682,918 A * 7/1987 Palm ..... B23B 31/123 279/60
5,052,496 A * 10/1991 Albert ..... B25F 3/00 173/171

(Continued)

FOREIGN PATENT DOCUMENTS

CN 107905740 A 4/2018
EP 1236545 A2 9/2002

OTHER PUBLICATIONS

International Preliminary Report on Patentability (IPRP) dated Sep. 18, 2020 issued in International Application No. PCT/EP2019/066732.

(Continued)

*Primary Examiner* — Nathaniel C Chukwurah
*Assistant Examiner* — Lucas E. A. Palmer
(74) *Attorney, Agent, or Firm* — Holtz, Holtz & Volek PC

(57) ABSTRACT

A handheld electric power tool includes a drive train assembly arranged along a longitudinal axis of the tool, a housing adapted to receive the drive train assembly, and a retaining ring. The housing includes a first portion and a second portion adapted to form the housing, which has a conical outer surface portion having a substantially circular cross section. The retaining ring includes an inner surface having a conical inner surface portion adapted to cooperate with the conical outer surface portion such that a force is exerted on the first and second housing portions via the retaining ring as the conical inner surface and the conical outer surface are axially displaced with respect to one another, thereby urging the first and second housing portion together.

15 Claims, 1 Drawing Sheet

(56) References Cited

U.S. PATENT DOCUMENTS 5,149,230 A * 9/1992 Nett ..... B25F 3/00 81/57.32
5,577,425 A * 11/1996 Holmin ..... B25F 5/02 81/57.39
7,475,609 B2 * 1/2009 Liaw ..... B25B 21/004 81/57.39
7,665,541 B2 * 2/2010 Sakai ..... B25F 5/029 173/217
8,235,137 B2 * 8/2012 Walker ..... B25F 5/001 173/217
8,480,453 B2 * 7/2013 Kobayashi ..... B25B 21/00 451/344
11,273,540 B2 * 3/2022 Andersson ..... B25B 21/00
2005/0090216 A1 * 4/2005 Hsu ..... B25B 21/004 455/184.1
2006/0040599 A1 * 2/2006 Young ..... B25F 5/00 451/359
2007/0084310 A1 * 4/2007 Kobayashi ..... B25B 21/00 81/57.39
2007/0256914 A1 * 11/2007 Lohr ..... B25B 23/18 200/5 A
2009/0221222 A1 * 9/2009 Lo ..... B25F 5/008 451/359
2010/0288522 A1 * 11/2010 Sun ..... B25F 5/02 173/168
2010/0326243 A1 * 12/2010 Bouchard ..... B25B 21/004 81/57.44
2011/0126676 A1 * 6/2011 Chiang ..... B25B 21/004 173/218
2011/0180289 A1 * 7/2011 Kumagai ..... B25F 5/02 173/90
2011/0263185 A1 * 10/2011 Nelson ..... B24B 41/007 451/358
2012/0319509 A1 * 12/2012 Kishima ..... B25B 21/00 310/50
2014/0053688 A1 * 2/2014 Yaschur ..... B25B 13/461 173/217
2021/0370489 A1 * 12/2021 Dance ..... B25F 3/00
2021/0370490 A1 * 12/2021 Dance ..... B25F 5/02
2022/0009072 A1 * 1/2022 Patterson ..... B23B 45/001

OTHER PUBLICATIONS

International Search Report (ISR) dated Oct. 11, 2019 issued in International Application No. PCT/EP2019/066732.
Written Opinion dated Oct. 11, 2019 issued in International Application No. PCT/EP2019/066732.
Chinese Office Action dated Feb. 17, 2023, issued in counterpart Chinese Application No. 201980043708.6.

* cited by examiner

HANDHELD ELECTRIC POWER TOOL

TECHNICAL FIELD

The present invention generally relates to a handheld electrical power tool, more particularly to a handheld electrical power tool comprising a housing and a retaining ring for such a housing, and an assembly method for such a power tool.

TECHNICAL BACKGROUND

Electrical power tools are known to be used in various industries, for example for tightening of screws. Apart from general demands on efficiency and durability of the tool, ergonomics has become a factor of major importance when choosing a suitable power tool. An operator of a power tool may be handling the tool during long working hours, and even the slightest discomfort may turn out to be a major concern. For example, the handle design directly affects the usability and the comfort level of the tool during operation and the design of the handle of the tool has therefore been shown to be of significant importance for providing an efficient and ergonomic working environment.

In order to improve ergonomics, tightening tools having specially designed grip or handle portions have been proposed. Further, the use of specific materials provided at the handle portion have been proposed in order to provide a suitable level of friction. Such designs however tend to be more expensive and may reduce the lifetime of the tool due to softer materials used for the handle being less resistant to wear.

Also known are using auxiliary supporting structures such as supporting handles or similar in order to improve ergonomics. However, in the case of designs involving additional grip portions, supporting handles or similar auxiliary components undue complexity may be added to the assembly process of the power tool itself.

One specific field of concern is power tools where the handle extends in the same direction as an axle of rotation of the tool, for example tools having a straight design, which poses certain specific constraints and challenges on handle design. One example of this type of tool is the type of tools commonly used for tightening of small screws for example in the electronics industry. More particularly, as these tools are usually light and the tightening operations tends to make to the tool rotate in the hand, the reaction torque is commonly absorbed by the operator at the end of the operating sequence. The design of the portion of the tool where the operators hand grips the tool and the friction between this portion and the hand is therefore of significant importance.

Hence, there exists a need for improvement in the field of ergonomics of handle design for power tools.

SUMMARY OF THE INVENTION

Accordingly, it would be desirable to provide a power tool comprising an improved housing including an improved handle portion. In particular, it would be desirable to provide a power tool having a housing including a handle portion providing improved ergonomics and which is easy to assemble. To better address one or more of these concerns a power tool and an assembly method as defined in the independent claims are provided. Preferred embodiments are defined in the dependent claims.

According to a first aspect of the invention a handheld electric power tool comprising a drive train assembly arranged along a longitudinal axis of the tool, a housing adapted to receive the drive train assembly and a retaining ring is provided. Wherein the housing comprises a first portion and a second portion adapted to form the housing including a conical outer surface portion having a substantially circular cross section, and wherein the retaining ring comprises an inner surface, the inner surface comprising a conical inner surface portion adapted to cooperate with the conical outer surface portion such that a radial force is exerted on the first and second housing portions by means of the ring as the conical inner surface and the conical outer surface are axially displaced with respect to one another, thereby urging the first and second housing portion together.

According to the first aspect, the power tool provides an inventive solution to the concerns described above by means of a design incorporating a retaining ring adapted to urge, or force, a first and second portion of the housing together by means of an inner conical surface of the ring cooperating with an outer conical surface of the housing formed by the first and second portion. More particularly, by means of the retaining ring, the need of additional locking means such as screws, rivets or similar is in fact eliminated or at least reduced as these elements may be replaced by the retaining ring. This is of particular importance with regards to screws or similar arranged at or near the handle portion of the tool, which may pose potentially harmful discontinuities in the housing structure and/or the handle portion. By means of the retaining ring replacing these elements, these issues may be eliminated and a smooth and comfortable securing of the housing portions may be provided. Hence the ergonomics of the housing and/or the handle portion of the tool may be significantly improved.

Further, the retaining ring is advantageous not only in that the ergonomics are improved, but also in that a more efficient and convenient method of assembly is provided. This since, as the housing is to be assembled, the first and second housing portions may be loosely fitted (or laid) together in order to together provide the assembled housing and thereafter the retaining ring may be arranged to hold the first and second portion together by means of a radial force. The assembled housing may in turn enclose an inner cavity in which a drive train assembly may be received, such a drive train assembly may comprise a motor, gears and a rotating axle. The retaining ring, and the cooperating conical surfaces are preferably adapted such that the radial force exerted as the respective conical surface move with respect to one another is sufficiently large to hold the housing together. I.e. a force corresponding to that of a screw or similar commonly used in the art. By radial force should be understood a force having at least a radial component, i.e. a component in a radial direction of the retaining ring and hence of the conical portion of the housing. The ring may in some embodiments be further be adapted to carry additional element, such as element on the outside of the ring having a contrasting color or texture.

The tool is commonly a type of tool where means for holding the housing together are commonly positioned at, or close to, a handle portion of the tool. Examples of such tools include straight tools and where a more or less cylindrical handle portion is provided at an end of the tool and the housing is commonly held together by suitable means at least at the first and the second end. In such tools, the provision of a retaining screw at the end of the tool holding the housing together as is known in the art may be particularly uncomfortable to the hand since the user not only holds the weight of the tool but commonly is exposed to a rotation of the tool with respect to the hand as the reaction torque is absorbed. Therefore, elimination of such screws by means of the inventive retaining ring according to the first aspect is particularly advantageous. In one advantageous embodiment, the power tool is a handheld power tool for tightening of small screws. For example such a tool comprising an internal vacuum channel or hose in order to provide a vacuum at (or to) a first end of the tool for facilitating the picking of screws, for such a tool the provision of a proper, sufficiently tight seal between a first and second portion of a housing may be particularly advantageous in that the vacuum may be efficiently applied without leaks. The skilled person however realizes that any other type of power tools is conceivable within the scope of the present invention. In some embodiments, the tool may further comprise or be connectable to a controller operative to control the power tool. In one embodiment, the power tool is a tool providing a lower tightening torque, for example in the range 1-50 cNm or in the range 1-25 cNm.

According to one embodiment, the housing has a first end and the outer surface portion is formed at the first end, such that the substantially circular outer surface portion forms a first end opening of the assembled housing. Hereby, the first portion and the second portion of the housing may each comprise a partially circular conical end surface, such that these end surfaces together form the substantially circular end opening.

According to one embodiment, the first end is a distal end of the power tool. By distal end should be understood a front end of the tool, or housing, i.e. an end of the housing arranged in closer proximity to the bit and bit holder of the tool at a front end of the tool.

According to one embodiment, the power tool further comprises a handle portion adapted to be gripped by a user, wherein the handle portion is arranged adjacent to the conical outer surface portion. For example, the conical outer surface may constitute a distal, or front, end opening of the housing, and the handle portion may be provided at or adjacent to this front end. Hereby, the beneficial effect of the elimination of screws or similar objects at the position where the hand grips the tool are of particular importance.

According to one embodiment, the first and second portion of the housing form a first and a second half of the housing, the first and second half being defined by a cross section through a longitudinal center line. Hereby, assembly of the tool may be facilitated as convenient access may be provided to a cavity defined by the first and second half of the housings in which components of the tool should be arrange. For example, the drive train assembly or other components may during assembly be conveniently arranged in the first half of the housing before the second half may be arrange on top of the more or less finally assembled structure as a cover.

According to one embodiment, the inner surface of the retaining ring further comprises threads. Such threads may be arranged on the conical surface itself, or on a separate thread portion of the inner surface. In some embodiments, this threaded portion may be a cylindrical surface portion. Some embodiments may comprise a quick coupling such as a bayonet coupling or a snap acting coupling. The first and second housing portion may in some embodiments comprise threads adapted to cooperate with the thread of the inner surface of the retaining ring.

According to one embodiment, the power tool further comprises a threaded sleeve coupled to the drive train assembly, wherein the threaded sleeve comprises threads adapted to cooperate with the threads of the inner surface of the retaining ring. This is particularly advantageous in that yet another inventive functionality may be provided in that the sleeve, being connected to the drive train, may be used as a means for positioning the drive train into a correct position utilizing a cooperation between the threaded sleeve and the retaining ring. This since as the ring is threaded onto the sleeve during an initial phase of rotation, the conical surfaces of the ring and the housing are axially displaced and the housing portions are forced together by means of the axial force generated. However, as maximum engagement there between is achieved, and the relative axial movement between the ring and the housing comes to an end, the relative rotation of the ring and the sleeve is instead translated into a relative axial movement between the sleeve, and hence the drive train assembly, and the retaining ring thereby allowing the drive train assembly to be drawn into a correct position. The interaction during this second phase of rotation may accordingly be described as something similar to a linear actuator effecting a linear movement of the drive train assembly as the retaining ring is held in a fixed axial position due to maximum engagement between the conical surfaces.

According to one embodiment, the threaded sleeve is adapted to at least partly extend through an end opening of the assembled housing. Hereby, access to a threaded portion of the sleeve is facilitated. Further, particularly in an embodiment wherein the conical outer surface portion forms a first end opening of the assembled housing, the sleeve may extend through the front end opening such that the drive train may be forwardly displaced by means of the retaining ring as explained above.

According to one embodiment, at least one of the first and second portion of the housing comprises a pin arranged at an inner surface of the portion, wherein the drivetrain assembly comprises an outer sleeve, the outer sleeve comprising a hole adapted to receive the pin, such that a contact pressure between the pin and an edge of the hole may be provided by means of a relative movement between the assembled housing and the drivetrain assembly. In other words, the pin and the hole provides, as the housing and the drivetrain are relatively displaced a point or area of contact (i.e. a connection) between the drive train assembly and the housing. After contact has been established, the contact pressure may be allowed to increase as the relative displacement increases. In one embodiment, the sleeve comprise two holes, and the housing comprises two pins. The holes may be arranged at opposite sides of the sleeve, i.e. 180° apart.

According to one embodiment, the relative moment between the assembled housing and the drivetrain assembly is a relative axial movement provided by means of a relative rotation of the threaded sleeve and the retaining ring. This for example since the retaining ring may cooperate with the threaded sleeve attached to the drive train assembly as explained above, such that the drive train including the outer sleeve in which the hole is provided is axially displaced with respect to the housing (comprising the pins), also explained above. This is particularly advantageous in an embodiment, wherein the at least one pin is adapted to provide an electrical connection to ground. This since the contact pressure achieved by means of the relative axial displacement resulting from the rotation of the retaining ring provides for a firm, well-established, electric contact between the sleeve of the drive train and the pin thus assuring a proper connection to ground for the tool and/or drive train assembly.

According to a second aspect of the present invention an assembly method for assembling a power tool according to any of the embodiments described above is provided. The method comprises the steps of providing a first housing portion and arranging a drive train assembly in the first portion, providing a second housing portion and arranging the second portion on the first portion, thereby at least partially enclosing the drive train assembly, and providing a retaining ring and effecting an axial displacement between the ring and the assembled housing, thereby providing a radial force between first and second portion of the housing urging the first and second housing portion together.

Hereby an efficient assembly of the power tool is achieved, advantageously allowing for a design of the housing wherein convenient access may be provided to a cavity defined by for example a first half of the housings in which components of the tool may during assembly be conveniently arranged before a second half may be arrange on top of the more or less finally assembled structure as a cover, and whereby proper retaining or locking is conveniently provided by means of the retaining ring. The assembly method may be performed by hand or if necessary by means of a suitable tool for effecting the axial displacement.

According to one embodiment, the assembly method further comprises the step of providing a threaded sleeve coupled to the drive train assembly and effecting an axial displacement between the drive train assembly and housing by means of relative rotation between the retaining ring and the threaded sleeve. Hereby may, as described in the foregoing, yet another inventive functionality be provided in that the sleeve, being connected to the drive train, may be used as a means for positioning the drive train with respect to the housing by means of the interaction between the sleeve and the retaining ring.

Further objectives of, features of and advantages of the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

The invention will be described in the following illustrative and non-limiting detailed description of exemplary embodiments, with reference to the appended drawing, wherein.

All figures are schematic, not necessarily to scale and generally only show parts which are necessary in order to elucidate the invention, wherein other parts may be omitted or merely suggested.

DETAILED DESCRIPTION

Figure 1:
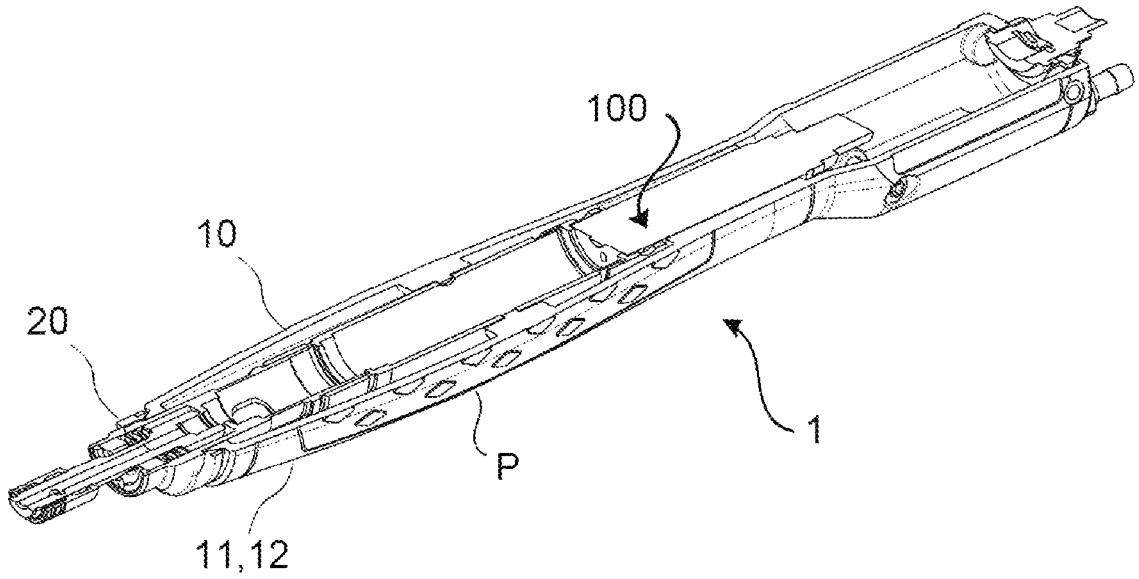
FIG. 1 is a perspective cross sectional view of a power tool according to one embodiment.

A power tool 1 comprising a housing 10 and a retaining ring 20 according to one embodiment is shown in a cross sectional view in FIG. 1. Due to cross sectional view, only a first portion 11 of the housing 10 is shown. As the cross section chosen for FIG. 1 is a cross section in a plane parallel to a longitudinal center line of the tool, the housing 10 is divided substantially in half and the illustrated first portion 11 is therefore also a first half of the housing 10. A drive train assembly 100 is schematically illustrated arranged in the first portion 11 of the housing, comprising a motor and a gearing (not shown) and an axle extending along the center line of the tool mentioned above (not shown). A handle portion P is arranged at an end of the tool 1 adjacent to the retaining ring 20.

Figure 2:
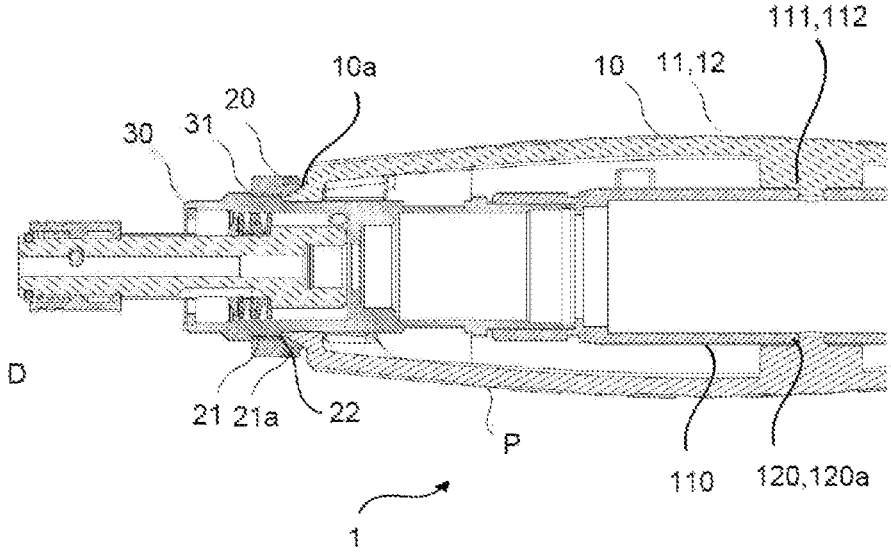
FIG. 2 is a cross sectional view of parts of a power tool according to one embodiment.

Turning to FIG. 2, the front part of the power tool 1 is shown in cross section in greater detail including the housing 10, more particularly a portion 11 or 12 of the housing, the retaining ring 20 and the schematically illustrated drive train assembly 100. In the following, this portion will be referred to as a first portion 11. As described above, the first portion 11 of the housing 10 is adapted to form the assembled housing along with the second portion 12 (not shown). The housing 10 comprises a conical outer surface portion (10*a*) having a substantially circular cross section, formed by the corresponding conical outer surfaces of the first and second portions 11, 12 of the housing. Hence, it follows that the conical outer surfaces of the first and second portions 11, 12 of the housing each have a partially circular cross section in order to make up the conical outer surface 10*a*.

The retaining ring 20 in turn comprises an inner surface 21, having a conical inner surface portion 21*a* adapted to cooperate with the conical outer surface portion 10*a*. Hereby, a radial force is exerted on the first and second housing portions 11, 12 by means of the ring 20 as the conical inner surface portion 21*a* and the conical outer surface 10*a* are axially displaced with respect to one another, thereby urging said first and second housing portion together. A handle portion P adapted to be gripped by a user is arranged at the same end of the tool 1, i.e. adjacent to the surface 10*a*.

During assembly, the drive train assembly 100 may be placed in the first portion 11 of the housing, thereafter the second housing portion 12 (not shown) may be placed on top of the portion 11, thereby at least partially enclosing said drive train assembly 110 and thereby also forming the assembled housing 10 including the conical outer surface 10*a*. Thereafter, the retaining ring 20 may be arranged adjacent to and thereafter axially displaced with respect to the surface 10*a* in order to provide a radial force on the first and second portions 11, 12 pressing them together. In the illustrated embodiment, the retaining ring 20 further comprises threads 22 arranged on a cylindrical portion of the inner surface 21 arranged closer to the distal end of the tool 1 compared to the conical surface 21*a*. The threads 22 are adapted to cooperate with the threads 31 of a threaded sleeve 30 coupled to the drive train assembly 100 and extending through the end opening of the housing 10 defined by the surface 10*a* such that, for example during assembly, as the ring 20 is threaded onto the sleeve during an initial phase of rotation, the conical surfaces 21*a*, 10*a* of the ring 20 and the housing 10 are axially displaced and the housing portions are forced together by means of the axial force generated as described above.

However, as maximum engagement there between is achieved, and the relative axial movement between the ring 20 and the housing 10 comes to an end, the relative rotation of the ring 20 and the sleeve 30 is instead translated into a relative axial movement between the sleeve 30, and hence the drive train assembly 100, and the retaining ring 20 thereby allowing the drive train assembly 100 to be drawn into a correct position with respect to the housing. To provide additional functionality, the drive train assembly 100 of the illustrated embodiment of FIG. 2 further comprises an outer sleeve 110, this outer sleeve in turn comprises two holes 120*a*, 120*b*. These holes are adapted to receive pins 111, 112 comprised by the housing 10, such that a connection may be established there between by means of a contact between the pins 111, 112 and the respective edges of the holes 120*a*, 120*b*. This contact is in fact established as the sleeve 30 is axially displaced with respect to the ring 20, as the threads of the ring 20 and the threads 31 of the ring 30 cooperate as described above. The pins 111, 112 as well as the edges of the holes 120*a*, 120*b* are electrically conductive and due to the provision of an electrical connection connecting the pins 111, 112 to ground, the connection between the pins and the holes 120*a*, 10*b* is utilized to provide a connection to ground for the drive train assembly.

While the invention has been illustrated and described in detail in the drawings and foregoing description, such illustration and description are to be considered illustrative or exemplary and not restrictive; the invention is not limited to the disclosed embodiment. The skilled person understands that many modifications, variations and alterations are conceivable within the scope as defined in the appended claims. Additionally, variations to the disclosed embodiments can be understood and effected by those skilled in the art in practicing the claimed invention, form a study of the drawings, the disclosure and the appended claims. In the claims, the word "comprising" does not exclude other elements or steps and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

The invention claimed is:

1. A handheld electric power tool comprising:

a drive train assembly arranged along a longitudinal axis of the tool;

a housing in which the drive train assembly is received; and a retaining ring, wherein the housing comprises a first portion and a second portion adapted to, when assembled, form the housing, which includes a conical outer surface portion having a substantially circular cross section, wherein an inner surface of the retaining ring comprises (i) a threaded portion having threads, and (ii) an unthreaded conical inner surface portion adjacent to the threaded portion along the longitudinal axis of the tool, the conical inner surface portion being adapted to cooperate with the conical outer surface portion such that a radial force is exerted on the first and second housing portions via the retaining ring as the conical inner surface portion and the conical outer surface portion are axially displaced with respect to one another, thereby urging the first and second housing portions together.

2. The power tool according to claim 1, wherein the housing has a first end and the conical outer surface portion is formed at the first end, such that the substantially circular cross section of the conical outer surface portion forms a first end opening of the assembled housing.

3. The power tool according to claim 2, wherein the first end is a distal end of the power tool.

4. The power tool according to claim 2, further comprising a handle portion adapted to be gripped by a user, wherein the handle portion is arranged adjacent to the conical outer surface portion.

5. The power tool according to claim 1, wherein the first and second portions of the housing form a first half and a second half of the housing, the first half and the second half being defined by a cross section in a plane parallel to a longitudinal centerline of the housing.

6. The power tool according to claim 5, further comprising a threaded sleeve coupled to the drive train assembly, wherein the threaded sleeve comprises threads adapted to cooperate with the threads of the threaded portion of the inner surface of the retaining ring.

7. The power tool according to claim 6, wherein the threaded sleeve is adapted to extend at least partly through an end opening of the assembled housing.

8. The power tool according to claim 1, wherein at least one of the first and second portions of the housing comprises a pin arranged at an inner surface thereof, and wherein the drive train assembly comprises an outer sleeve, the outer sleeve comprising a hole adapted to receive the pin, such that a contact pressure between the pin and an edge of the hole can be provided by a relative movement between the assembled housing and the drive train assembly.

9. The power tool according to claim 8, wherein the relative movement between the assembled housing and the drive train assembly is a relative axial movement provided by a relative rotation of the threaded sleeve and the retaining ring.

10. The power tool according to claim 8, wherein the pin is adapted to provide an electrical connection to ground.

11. A method for assembling the power tool according to claim 1, the method comprising:

providing the first portion of the housing and arranging the drive train assembly in the first portion;

providing the second portion of the housing and arranging the second portion on the first portion, thereby at least partially enclosing the drive train assembly; and providing the retaining ring and effecting an axial displacement between the retaining ring and the assembled housing, thereby providing the radial force between first and second portions of the housing urging the first and second housing portion together.

12. The method according to claim 11, further comprising:

providing a threaded sleeve coupled to the drive train assembly and effecting an axial displacement between the drive train assembly and the housing by relative rotation between the retaining ring and the threaded sleeve.

13. The power tool according to claim 1, wherein the threaded portion is provided at a position outward of the conical inner surface portion toward a distal end of the tool.

14. The power tool according to claim 13, wherein the threaded portion does not overlap with the conical outer surface portion along the longitudinal axis of the tool.

15. A handheld electric power tool comprising:

a drive train assembly arranged along a longitudinal axis of the tool;

a housing adapted to receive the drive train assembly; and a retaining ring, wherein the housing comprises a first portion and a second portion adapted to, when assembled, form the housing, which includes a conical outer surface portion having a substantially circular cross section, wherein the retaining ring comprises an inner surface, the inner surface comprising a conical inner surface portion adapted to cooperate with the conical outer surface portion such that a radial force is exerted on the first and second housing portions via the retaining ring as the conical inner surface portion and the conical outer surface are axially displaced with respect to one another, thereby urging the first and second housing portions together, wherein the inner surface of the retaining ring further comprises threads, wherein at least one of the first and second portions of the housing comprises a pin arranged at an inner surface thereof, wherein the drive train assembly comprises an outer sleeve, the outer sleeve comprising a hole adapted to receive the pin, such that a contact pressure between the pin and an edge of the hole can be provided by a relative movement between the assembled housing and the drive train assembly, and wherein the pin is adapted to provide an electrical connection to ground.

* * * * *